US005159354A

United States Patent [19]

Hirasawa et al.

[11] Patent Number: 5,159,354

[45] Date of Patent: Oct. 27, 1992

[54] LIQUID JET RECORDING HEAD HAVING TAPERED LIQUID PASSAGES

[75] Inventors: Shinichi Hirasawa, Yokohama; Masayoshi Tachihara, Chofu, both of Japan

[73] Assignee: Canon Kabushiki Kaisha, Tokyo, Japan

[21] Appl. No.: 642,409

[22] Filed: Jan. 17, 1991

[30] Foreign Application Priority Data

Jan. 17, 1990 [JP] Japan ..... 2-6252

[51] Int. Cl.[5] ..... B41J 2/05

[52] U.S. Cl. ..... 346/140 R

[58] Field of Search ..... 346/140

[56] References Cited

U.S. PATENT DOCUMENTS

| | | | |
|---|---|---|---|
| 4,317,124 | 2/1982 | Shirato | 346/140 |
| 4,410,899 | 10/1983 | Haruta et al. | 346/140 R |
| 4,723,136 | 2/1988 | Suzumura | 346/140 R |
| 4,752,787 | 6/1988 | Matsumoto et al. | 346/140 R |
| 4,897,674 | 1/1990 | Hirasawa | 346/140 |
| 5,023,630 | 6/1991 | Moriyama | 346/140 |

FOREIGN PATENT DOCUMENTS

| | | |
|---|---|---|
| 3539095 | 7/1986 | Fed. Rep. of Germany . |
| 56-139970 | 10/1981 | Japan . |
| 59-194865 | 11/1984 | Japan . |
| 60-204352 | 10/1985 | Japan . |
| 64-087356 | 3/1989 | Japan . |
| 1-195050 | 4/1989 | Japan . |

*Primary Examiner*—Joseph W. Hartary

*Attorney, Agent, or Firm*—Fitzpatrick, Cella, Harper & Scinto

[57] ABSTRACT

A liquid jet recording head includes a plurality of ejection outlets through which droplets of liquid are ejected by thermal energy, a plurality of liquid passages communicating with the ejection outlets to supply the liquid, a plurality of supply inlets for supplying the liquid to the passages and a plurality of electro-thermal transducers provided for the respective ejection outlets to produce the thermal energy. Each of the electro-thermal transducers has a heating surface, on the bottom of a corresponding passage, for heating the liquid, and the width of each passage measured in the direction in which the passages are arranged is a maximum at a position between an end of the electro-thermal transducer element near the ejection outlet and an end thereof near the supply inlet, and the width decreases both toward the ejection outlet and toward the supply inlet. This allows the bubble created in the passage by the transducer to expand freely and provides energy-efficient droplet ejection.

5 Claims, 5 Drawing Sheets

LIQUID JET RECORDING HEAD HAVING TAPERED LIQUID PASSAGES

FIELD OF THE INVENTION AND RELATED ART

The present invention relates to a liquid jet recording apparatus wherein recording is effected by ejecting droplets of liquid through an ejection outlet, using thermal energy.

Prior Art

In a liquid jet recording apparatus using thermal energy, an electro-thermal transducer is used to eject droplets of the liquid. The thermal energy produced thereby is effective to vaporize the liquid and form a bubble, by which a pressure is produced to eject the liquid in the form of a droplet.

Such a system is advantageous because, among others reasons, the ejection outlets can be disposed at a high density so that high resolution images can be recorded.

The high density arrangement, however, requires narrow liquid passages communicating with the ejection outlets. The narrow passages have higher inertance and impedance, which requires a longer time period for the liquid to refill the passage from the liquid supply side. This prevents increase of the recording speed.

By the reduction of the length of the passage, the refilling time period can be reduced. If, however, this is done, the speed and the volume of the ejected liquid reduces, with the result that the stable recording is not possible.

Japanese Laid-Open Pat. Application No. 204352/1985 proposes, in an attempt to solve this problem to stabilize the liquid ejection with the short passage, that an ink jet recording head has a resistance to reduce flow of the liquid in the passage to the supply side from the electro-thermal transducer.

Japanese Laid-Open Pat. Application No. 87356/1989 proposes, in an attempt to increase a percentage of the energy of the bubble contributable to the ejection of the liquid, that the cross-sectional area of the passage adjacent the electro-thermal transducer increases toward the ejection outlet.

Japanese Laid-Open Pat. Application No. 195050/1989 proposes that the top wall of the passage is made higher in the neighborhood of the electro-thermal transducer than the other portion so that the liquid passage is not blocked by the bubble (U.S. Pat. No. 4,410,899).

In the system disclosed in Japanese Laid-Open Pat. Application No. 204352/1985, there arise the following problems:

(1) the difficulty in the provisions of the resistances in the passages increases with the increase of the density of the nozzles and with the increase of the number of the ejection outlets of the recording apparatus.

(2) If the resistance is too remote from the electro-thermal transducer, the effects of the resistances reduces; and if it is too near, the produced bubble develops to the clearance between the wall of the passage and the resistance with the result of the reduction of the effects of the resistances.

Therefore, the optimum design of the configuration, dimension and position or the like is difficult, and even if the optimum design is made, the effects are not sufficient.

The method disclosed in Japanese Laid-Open Pat. Application No. 87356/1989 involves a problem that the multi-nozzle structure is difficult, although the energy use efficiency is improved. In this method, the cross-sectional area of the passages is increased toward the ejection side with the result of the thin wall between the adjacent passage. If the wall is too thin, the strength may become insufficient, or the pressure of the bubble is transmitted to the adjacent passages, and therefore, the proper ejection is not expected. For these reasons, the method is not suitable to increase the high density arrangement or to increase the number of the nozzles.

According to the arrangement disclosed in the Japanese Laid-Open Pat. Application No. /95050/1989, the liquid passage is not blocked by the bubble, and therefore, the liquid can be sufficiently supplied, so that the ejection is stabilized. However, the publication simply states that the top wall of the passage is made higher at the energy applying portion than the other portion.

SUMMARY OF THE INVENTION

Accordingly, it is a principal object of the present invention to provide a liquid jet recording head having plural ejection outlets disposed at a high density.

It is another object of the present invention to provide a liquid jet recording head capable of ejecting a liquid droplet at a high speed.

It is a further object of the present invention to provide a liquid jet recording head capable of ejecting a liquid droplet having a sufficient volume.

It is a further object of the present invention to provide a liquid jet recording head capable of refilling the ejected liquid at a high speed.

It is a further object of the present invention to provide a liquid jet recording head wherein an impedance at the side downstream of a pressure producing portion in a liquid passage is different from that of the upstream side with respect to the flow of the liquid upon the liquid ejection, in consideration of the liquid flow upon ejection and during refilling liquid supply.

According to an embodiment of the present invention, the degree of width reduction is higher toward the ejection outlet than toward the supply inlet. That is, in a simple structure wherein the reductions toward the ejection outlet and the supply inlet are rectilinear, the inclination of the walls constituting the passage wall is higher toward the ejection outlet than toward the supply inlet.

DESCRIPTION OF THE PREFERRED EMBODIMENT

Preferred embodiments of the invention will be described in conjunction with the accompanying drawings.

Figure 1:
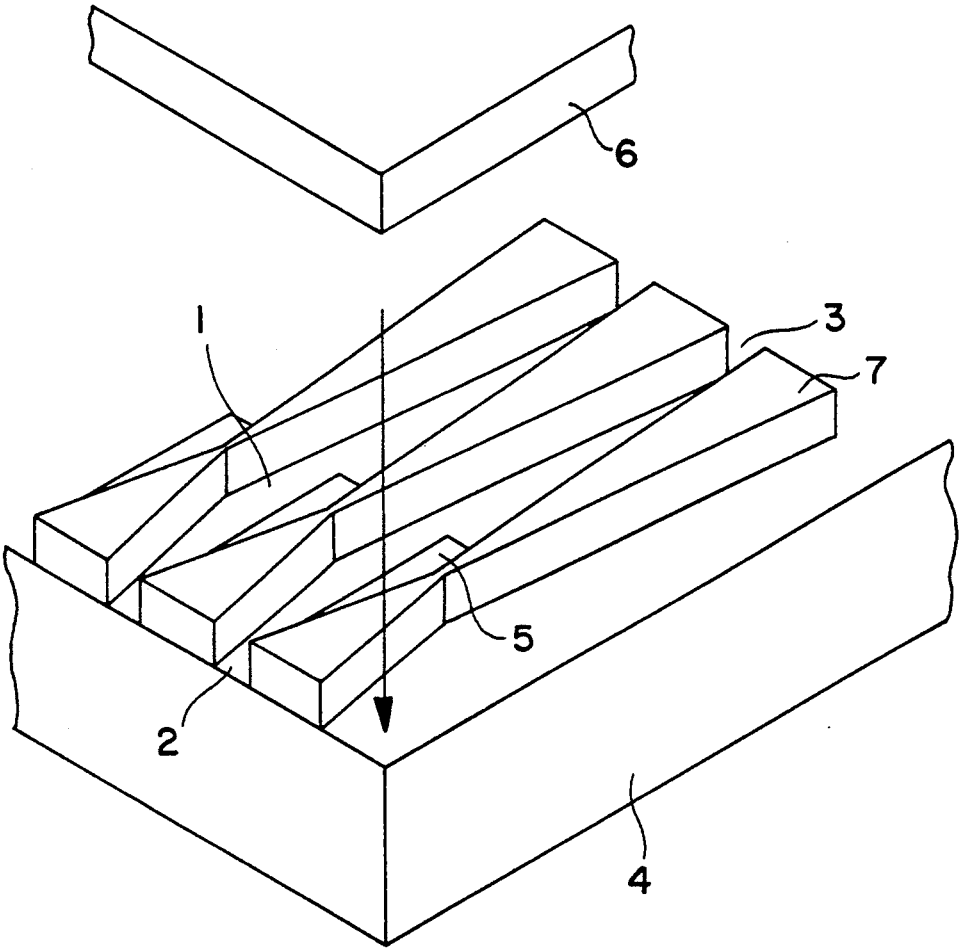
FIG. 1 is a partial perspective view of a liquid jet recording head according to an embodiment of the present invention.

As shown in FIG. 1, partition walls T are formed on a base 4 at regular intervals, and electro-thermal transducer elements 5 are disposed between adjacent walls. A top plate 6 is attached to provide a liquid jet recording head. The space defined by the walls, base and the top plate is a liquid passage 1, the liquid to be ejected out is supplied from an inlet and is ejected through the ejection outlet 2.

Adjacent the electro-thermal transducer element, the width of the wall is substantially zero to provide the maximum width of the passage, although the wall has a small width for explanation in the Figure.

The dimensions are as follows:

Cross-sectional area of the ejection outlet: $40\times30$ micron$^2$

Length of the passage: 500 microns

Height of the liquid passage: 400 microns

Size of the electro-thermal transducer element: $32\times150$ micron$^2$

Pitch of passages: 105.8 microns

The maximum width of the passage is 95 microns (electro-thermal transducer element portion), and the minimum width is 30 microns (inlet portion).

Figure 2:
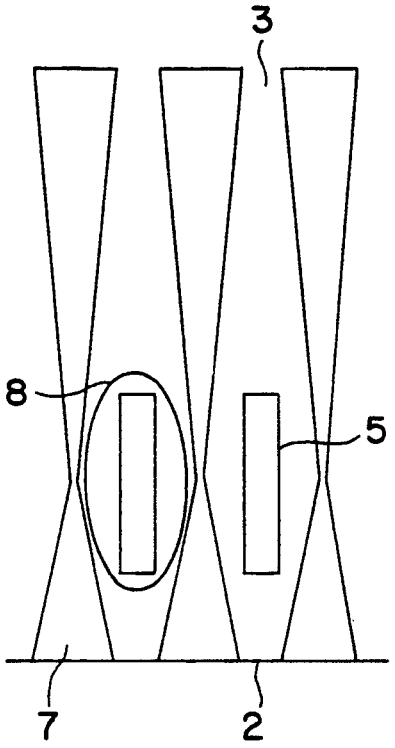
FIG. 2 is a top plan view of the liquid passage of the liquid jet recording head of FIG. 1.
Figure 3:
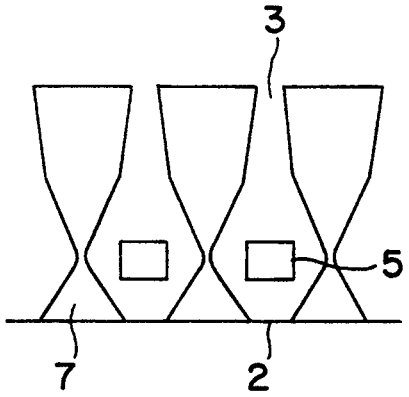
FIG. 3 is a top plan view of the passage according to a second embodiment of the present invention.

FIG. 2 is a top plan view of the liquid passage in this embodiment.

Figure 6:
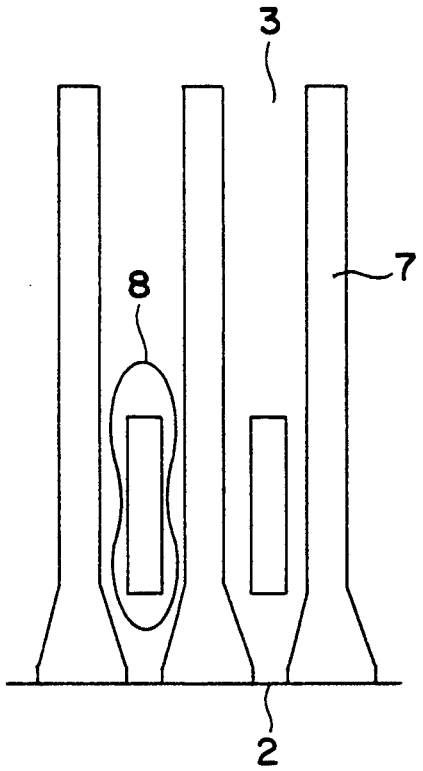
FIG. 6 PRIOR ART
FIG. 6 is a top plan view of a conventional liquid jet recording head.

FIG. 6 is a top plan view of a conventional passage. In the conventional passage, the liquid passage is not converging toward the supply inlet 3. The dimensions of the conventional passage are the same as those of the embodiment except that the maximum width is 70 microns (the major portion of the passage, and that the minimum is 35 microns (ejection outlet portion).

Operation of the first embodiment will be described in comparison with the conventional structure. When the electric pulse is applied to the electro-thermal transducer element, a bubble 8 is produced, as shown in FIG. 6, and it develops. In this embodiment, the width of the passage is maximum at the portion of the electro-thermal transducer element, and therefore, the bubble can develops with less influence of the partition walls, and freely develops into an oval form. In the comparison example, the maximum passage width is smaller than that of this embodiment due to the structure thereof, and therefore, the development of the bubble is influenced by the walls so that the bubble becomes much longer than the length of the electro-thermal transducer element and forms into the shape as shown in FIG. 6. Therefore, the energy of the bubble can be used more efficiently in this embodiment than in the comparison example.

During the subsequent liquid supply period, the liquid flows slowly from the inlet, and therefore, the impedance of the passage during the liquid supply is smaller than in the ejection period, but this does not apply to the conventional passage. The structure of the conventional passage has the same impedance upon the ejection and during the supply, and therefore, different properties depending on whether it is the ejection period or supply period cannot be provided. The impedance has been determined as a compromise. According to the present invention the desirable different properties can be provided.

The description will be made in further detail. The structure of the liquid passage, more particulary, the size, position, thermal energy to be produced, passage resistance, dimension of the ejection outlet and the like, is determined in consideration of the size of the droplet and the speed of the droplet. They are not all determined freely because of the limitations due to the manufacturing process and the geometrical limitation. If there were no limitation, the liquid passage would be as short and wide as possible since then the passage resistance (impedance and inertance) would be optimum and the efficiency would be high, and size and the speed of the droplet would be determined by the adjustment of the size and position of the electro-thermal transducer element and the size of the ejection outlet. Actually, however, there is a partition wall between adjacent passages in the case of multi-nozzle arrangement, and therefore, the nozzle width is limited, and the consideration should be paid to the mechanical strength of the wall.

The embodiment uses the directivity (direction dependence) and the flow-dependence of the liquid impedance. The impedance of the passage is desired to be as small as possible, as described above. The impedance is different upon the liquid ejection and upon the liquid supply.

Now, the consideration will be made separately for the inlet side (back side) and outlet side (front side) of the electro-thermal transducer. Upon ejection, the liquid is desirably easily mobile at the front side, and is less mobile at the back side, that is the impedance is desirably smaller at the front side and larger at the back side. Upon the liquid supply period, the liquid retracted into the passage tends to return, and therefore, the liquid is desirably easily mobile both at the inlet and outlet sides, that is, the impedance is desirably smaller both at the inlet and outlet side. Therefore, the front impedance is desirably always small, and the back impedance is desirably large upon the ejection and small upon the supply. Thus, the back side impedance is desired to be different.

The present invention has been made in consideration of the width. The relation between the width and the impedance is that the impedance decreases with increase of the width. Upon the ejection of the recording liquid, the width of the front side is desired to be large, and the width of the back side is desired to be small, but during the liquid supply period, the width at the back side is desired to be large. So, different and contradicting properties are desired. This is difficult to solve, a solution has been found in consideration of the difference of the liquid movement upon the ejection and during the supply period.

More particularly, the difference between the length of the time period required for the ejection and the length of the time period required for the liquid supply has been noted. The ejection is effected in a short period of time, and therefore, the liquid movement speed is high, but the supply is effected in a long period, and therefore, the speed of the liquid flow is low. It has been found that by considering the flow rate difference and the passage structure, the impedance can acquire directivity and speed-dependency.

The description will first be made as to the back side of the passage. According to the present invention, the liquid, upon the ejection, tends to flow at a high speed through the passage converging monotonically (in this case continuously from the electro-thermal transducer to the supply inlet, and therefore, it does not easily flow.

In other words, the impedance is larger than when the width is constant, and therefore, the ejection is efficient. During the supply, the liquid flows in the opposite direction at a low speed through the passage diverging from the inlet side to the electro-thermal transducer, and therefore, the impedance is smaller, so that the liquid supply is effected smoothly.

The front side will be described. In the front side the flow of the liquid is toward the outlet, that is, from the electro-thermal transducer to the ejection outlet upon the ejection and the supply. Therefore, the passage is desirably diverging monotonically (in this case continuously) toward the ejection outlet, in order to increase the efficiency.

From the above, it results that the passage is diverging from the inlet to the outlet. However, the front side of the passage has to take the role for controlling the size of the droplet and the control of the droplet speed. Therefore, the structure cannot be determined only from the standpoint of the efficiency. In addition, the simple diverging structure does not meet the demand for the increased nozzle density. Then, the passage structure of the present invention is achieved. Because of the structure of the present invention, the desired size and speed of the droplet can be provided, and the multi-nozzle structure at high density is achieved.

According to the present invention, the back side structure diverging toward the electro-thermal transducer permits the maximum passage width as close as possible to the pitch of the nozzle arrangement at the position where the electro-thermal transducer element is disposed, so that the passage impedance of the entire passage can be reduced. The length of that portion of the passage where the width is maximum is made extremely small, and the passage width monotonously reduces both toward the inlet and the outlet, whereby the insufficient mechanical strength resulting from the insufficient thickness of the wall between adjacent passages, can be avoided. In addition, the possible influence from the pressure produced in the adjacent nozzle can be avoided. The length in which the width is maximum is determined on the basis of the property of the material constituting the passage, the degree of converging to the inlet and the outlet and the like. The largest maximum width can be provided when the length is zero, that is, when the maximum width appear only at a point. The nozzle structure is particularly effective when plural nozzles are used, particularly at a high density. In addition, the distances from the electro-thermal transducer and the side walls are large, so that the bubble is not limited by the side walls, and therefore, it can develop freely, by which the energy conversion efficiency to the ejection energy can be increased.

As will be understood from FIGS. 1 and 2, the degree of converging from the electro-thermal transducer toward the ejection outlet is higher than that toward the supply inlet. In other word, the taper of the wall constituting the width of the passage is steeper at the front side than at the back side. By doing so, the maximum width position can be closer to the ejection outlet, and the width of the electro-thermal transducer element is increased, and in addition, the passage is shortened.

The reason why the electro-thermal transducer element can be made closer to the ejection outlet, is that the bubble can develop freely so that the bubble does not expand in the direction of the liquid flow. In the conventional structure, if the electro-thermal transducer element is too close to the ejection outlet, the bubble communicates with the external air with the result of improper ejection. According to the present invention that liability is removed. In addition, since the electro-thermal transducer element is close to the ejection outlet, the ejection can be effected with a small electro-thermal transducer element, and therefore, the efficiency is improved, and the energy consumption can be reduced. Since the length is reduced, the impedance of the entire passage can be reduced.

Embodiment 2

The liquid jet recording head of the second embodiment is the same as the first embodiment except that the length of the passage is 200 microns and that the size of the electro-thermal transducer element is $45\times35$ micron$^2$. This embodiment uses most the advantages of the large width of the passages. The maximum width position is further closer to the ejection outlet, and the width of the electro-thermal transducer element is increased, and in addition, the passage is shortened.

As described in the foregoing, the reason why the electro-thermal transducer element is made closer to the ejection outlet, is that the bubble can develop freely so that the bubble does not expand in the direction of the liquid flow. In the conventional structure, if the electro-thermal transducer element is too close to the ejection outlet, the bubble communicates with the external air with the result of improper ejection. According to the present invention that liability is removed. In addition, since the electro-thermal transducer element is close to the ejection outlet, the ejection can be effected with a small electro-thermal transducer element, and therefore, the efficiency is improved, and the energy consumption can be reduced. Since the length is reduced, the impedance of the entire passage can be reduced.

Embodiment 3

Figure 4:
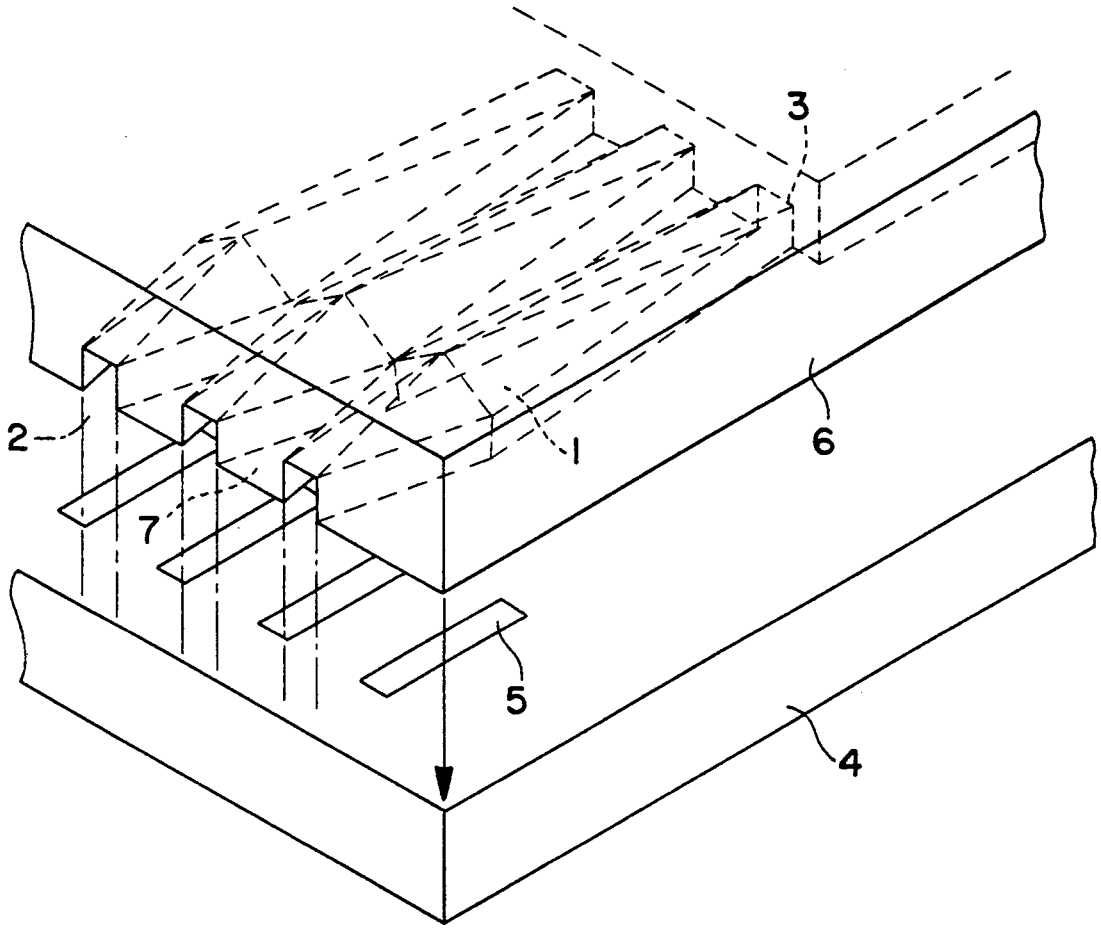
FIG. 4 is a partial perspective view of the liquid jet recording head according to a third embodiment of the present invention.

As shown in FIG. 4, the electro-thermal transducer elements 5 are disposed at regular intervals on the base 4 (some parts are omitted for the sake of simplicity in this Figure). The top plate 6 has grooves at the positions corresponding to the electro-thermal transducer elements 5 to establish the liquid passages. The top plate 6 is attached to the base to form a liquid jet recording head. The adjacent passages are separated from each other by the partition wall 7. The liquid to be ejected is supplied from the supply inlet 3 and is ejected out through the outlet 2. Adjacent the electro-thermal transducer element, the width of partition wall is substantially zero (in the Figure, the it has a small width for explanation) to provide the maximum width of the passage. In addition, the height of the passage is made maximum to provide the maximum cross-sectional area of the passage.

Figure 5A:
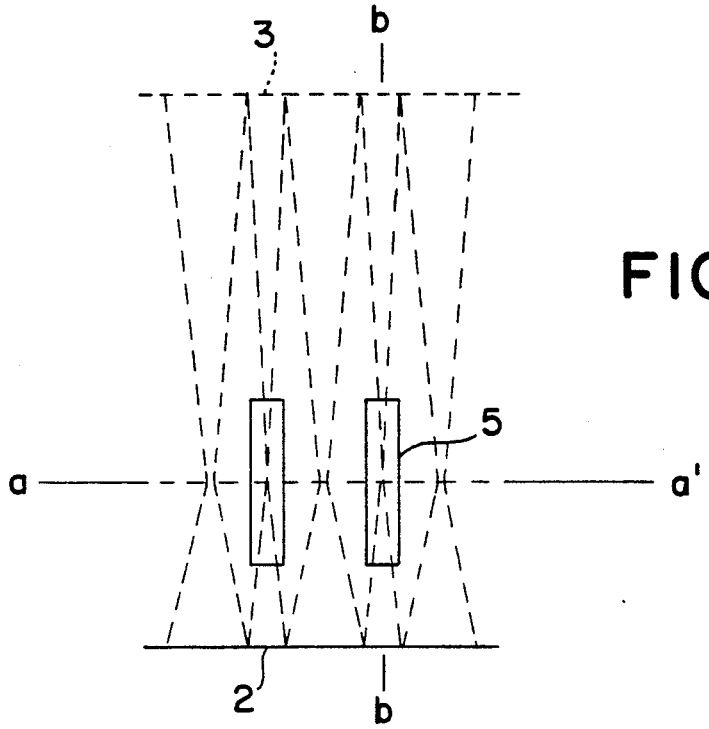
FIG. 5A is top plan view of the passage.
Figure 5B:
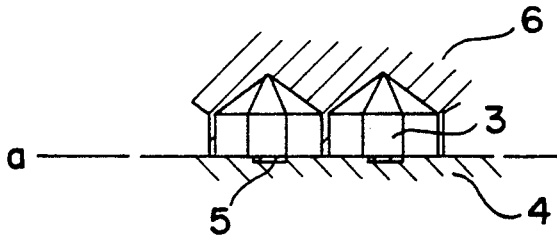
FIGS. 5B and 5C are sectional views of the passage.
Figure 5C:
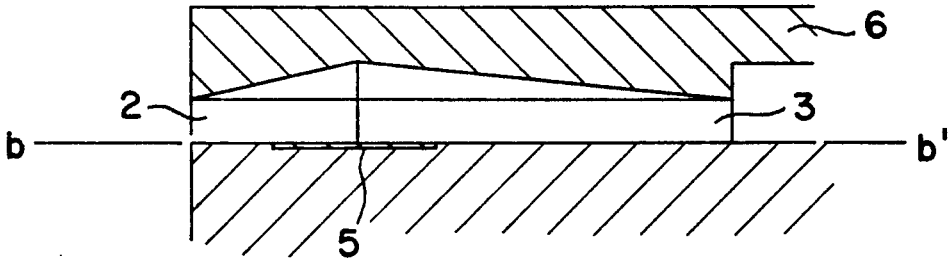

The dimensions of the passage are the same as those of the first embodiment with the exception that the cross-sectional area of the ejection outlet is $35\times35$ micro2 and that the maximum height of the passage is 60 microns. FIG. 5(*a*) is a top plan view of the passage according to this embodiment, and FIGS. 5(*b*) and 5(*c*) are a—a′ and b—b′ sectional views, respectively. As will be understood from FIG. 5(*c*), the top wall of the passage is tapered in the similar manner as the side walls described in the foregoing.

The same advantageous effects are provided.

TABLE 1

| | Ejection volume ($10^{-9}$ cc) | Ejection speed (m/s) | Refilling time (micro-sec) |
|---|---|---|---|
| Embodiment 1 | 126 | 11 | 282 |
| Embodiment 2 | 130 | 14 | 222 |
| Embodiment 3 | 136 | 13 | 250 |
| Comparison | 81 | 8.5 | 316 |

Table 1 shows the properties of the recording head according to Embodiments 1, 2, 3 and comparison example. As will be understood, the recording head according to the embodiments is advantageous.

According to the present invention, the efficiency of use of the bubble energy for the ejection is improved, and the high density arrangement of the nozzles is possible. The width of the passage can be used to the maximum extent, so that the efficiency is further improved. The energy consumption can be reduced. The ejection speed is the same or higher than that of the conventional structure.

What is claimed is:

1. A liquid jet recording head comprising:

a plurality of ejection outlets through which a droplet of liquid can be ejected by thermal energy;

a plurality of liquid passages communicating with the ejection outlets to supply the liquid;

a plurality of supply inlets for supplying the liquid to the passages; and a plurality of electro-thermal transducers provided for the respective ejection outlets to produce the thermal energy;

wherein each of the electro-thermal transducers has a heating surface for heating the liquid on the bottom of the passage, characterized in that a width of each passage measured in the direction in which the passages are arranged is a maximum at a position between an end of the electro-thermal transducer element near the ejection outlet and an end thereof near the supply inlet, and that the width of each passage decreases monotonically from the maximum toward the ejection outlet and toward the supply inlet.

2. A recording head according to claim 1, wherein a height of each passage decreases monotonically toward the ejection outlet and toward the supply inlet.

3. A recording head according to claim 1, wherein the width decreases at a higher rate toward the ejection outlet than toward the supply inlet.

4. A liquid jet recording head comprising:

a plurality of ejection outlets through which a droplet of liquid can be ejected by thermal energy;

a plurality of liquid passages communicating with the ejection outlets to supply the liquid;

a plurality of supply inlets for supplying the liquid to the passages; and a plurality of electro-thermal transducers provided for the respective ejection outlets to produce the thermal energy;

wherein each of the electro-thermal transducers has a heating surface for heating the liquid on the bottom of the passage, characterized in that a width of each passage measured in the direction in which the passages are arranged is a maximum at a position between an end of said electro-thermal transducer element near the ejection outlet and an end thereof near the supply inlet, the width of each passage decreases monotonically from the maximum toward the ejection outlet and toward the supply inlet, and a degree of the decrease is steeper toward the ejection outlet than toward the supply inlet.

5. A liquid jet recording head comprising:

a plurality of ejection outlets through which a droplet of liquid can be ejected by thermal energy;

a plurality of liquid passages communicating with the ejection outlets to supply the liquid;

a plurality of supply inlets for supplying the liquid to the passages; and a plurality of electro-thermal transducers provided for the respective ejection outlets to produce the thermal energy and create a bubble in the liquid in the passage;

wherein each of the electro-thermal transducers has a heating surface for heating the liquid on the bottom of said passage, characterized in that a width of each passage measured in the direction in which the passages are arranged is a maximum at a position that provides a substantially free expansion region for the bubble created in the passage and the width of each passage decreases monotonically from the maximum toward the ejection outlet and toward the supply inlet.

* * * * *

UNITED STATES PATENT AND TRADEMARK OFFICE

CERTIFICATE OF CORRECTION

PATENT NO. : 5,159,354

DATED : October 27, 1992

INVENTOR(S) : Shinichi Hirasawa, et al

It is certified that error appears in the above-identified patent and that said Letters Patent is hereby corrected as shown below:

COLUMN 1

Line 62, "resistances" should read --resistance--.

COLUMN 2

Line 16, "Application No. /95050/1989," should read --Application No. 195050/1989,--.

COLUMN 3

Line 2, "EMBODIMENT" should read --EMBODIMENTS--.
Line 7, "partition walls T" should read --partition walls 7--.
Line 37, "passage," should read --passage)--.
Line 46, "develops" should read --develop--.

COLUMN 4

Line 49, "solve, a" should read --solve, but a--.
Line 67, "continuously" should read --continuously)--.

COLUMN 5

Line 46, "appear" should read --appears--.
Line 57, "word," should read --words,--.

UNITED STATES PATENT AND TRADEMARK OFFICE

CERTIFICATE OF CORRECTION

PATENT NO. : 5,159,354

DATED : October 27, 1992

INVENTOR(S) : Shinichi Hirasawa et al

It is certified that error appears in the above-indentified patent and that said Letters Patent is hereby corrected as shown below:

Column 6, line 51, "partition" should read --the partition-- line 52, "the" (second occurrence) should be deleted.

line 60, "cro2" should read --$crons^2$--.

Signed and Sealed this

Sixteenth Day of November, 1993

Bruce Lehman

*Attest:*

BRUCE LEHMAN

*Attesting Officer*

*Commissioner of Patents and Trademarks*